US011555630B2

(12) United States Patent
Qin et al.

(10) Patent No.: US 11,555,630 B2
(45) Date of Patent: Jan. 17, 2023

(54) AIR CONDITIONER INDOOR UNIT AND AIR CONDITIONER

(71) Applicants: MIDEA GROUP CO., LTD., Foshan (CN); GD MIDEA AIR-CONDITIONING EQUIPMENT CO., LTD., Foshan (CN)

(72) Inventors: Qiang Qin, Foshan (CN); Xinchang Chen, Foshan (CN); Xiansong Wang, Foshan (CN); Zhenmin Cui, Foshan (CN); Tao Rao, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 405 days.

(21) Appl. No.: 16/722,633

(22) Filed: Dec. 20, 2019

(65) Prior Publication Data

US 2020/0124315 A1 Apr. 23, 2020

Related U.S. Application Data

(63) Continuation of application No. PCT/CN2017/105096, filed on Sep. 30, 2017.

(30) Foreign Application Priority Data

Jun. 21, 2017 (CN) ..... 201710480102.1

(51) Int. Cl.
*F24F 13/02* (2006.01)
*F24F 1/0057* (2019.01)
(Continued)

(52) U.S. Cl.
CPC ..... *F24F 13/0245* (2013.01); *F24F 1/0057* (2019.02); *F24F 13/0209* (2013.01); *F24F 13/20* (2013.01); *F24F 2013/227* (2013.01)

(58) Field of Classification Search
CPC .. F24F 1/0057; F24F 1/0007; F24F 2013/227; F24F 13/222; F24F 13/0245; F24F 13/20
See application file for complete search history.

(56) References Cited

U.S. PATENT DOCUMENTS

2005/0115264 A1* 6/2005 Terada ..... F24F 1/0067 62/298
2013/0105114 A1 5/2013 Yoon et al.
2015/0040602 A1* 2/2015 Park ..... F24F 1/0057 62/291

FOREIGN PATENT DOCUMENTS

CN 1521467 A 8/2004
CN 1920431 A 2/2007
(Continued)

OTHER PUBLICATIONS

World Intellectual Property Organization (WIPO) Written Opinion for PCT/CN2017/105096 with translation dated Apr. 3, 2018 8 Pages.

(Continued)

*Primary Examiner* — Lionel Nouketcha
(74) *Attorney, Agent, or Firm* — AnovaLaw Group PLLC

(57) ABSTRACT

An air conditioner indoor unit includes an air outlet frame, a front water receiving tray, and a panel. The air outlet frame includes an upper enclosure plate, a lower enclosure plate, and a side enclosure plate located between and connecting the upper enclosure plate and the lower enclosure plate. The front water receiving tray is above the upper enclosure plate and includes a protrusion section protruding out of the side enclosure plate and a water outlet hose at the protrusion section. The water outlet hose is configured to be received in a receiving cavity formed below the protrusion section and opening forward. The panel includes a cover member configured to cover the receiving cavity when the panel is in a closed state.

20 Claims, 5 Drawing Sheets

(51) Int. Cl.
*F24F 13/20* (2006.01)
*F24F 13/22* (2006.01)

(56) References Cited

FOREIGN PATENT DOCUMENTS

| | | | | | |
|---|---|---|---|---|---|
| CN | 203240730 | U | | 10/2013 | |
| CN | 204786776 | U | | 11/2015 | |
| CN | 105928078 | A | | 9/2016 | |
| CN | 106369786 | A | | 2/2017 | |
| CN | 106839130 | A | | 6/2017 | |
| CN | 106839130 | A | * | 6/2017 | ..... F24F 1/00 |
| CN | 106871245 | A | | 6/2017 | |
| CN | 107101278 | A | | 8/2017 | |
| CN | 206919176 | U | | 1/2018 | |
| EP | 2469194 | A1 | | 6/2012 | |
| JP | 6219527 | U | | 2/1987 | |
| JP | H10170017 | A | | 6/1998 | |
| JP | 2001254968 | A | | 9/2001 | |
| JP | 2002333159 | A | | 11/2002 | |
| JP | 2008095993 | A | | 4/2008 | |
| JP | 2015099005 | A | | 5/2015 | |
| WO | 2014115662 | A1 | | 7/2014 | |

OTHER PUBLICATIONS

The European Patent Office (EPO) Extended Search Report for EP Application No. 17914132.0 dated Apr. 7, 2020 10 Pages.

Japan Patent Office Reasons for Refusal for Japanese Application No. 2019570995 dated Feb. 2, 2021 10 Pages (including English translation).

Search Report by Registered Search Organization Search Report Japanese Application No. 2019570995 dated Jan. 26, 2021 42 Pages(including English translation).

World Intellectual Property Organization (WIPO) International Search Report for PCT/CN2017/105096 dated Apr. 3, 2018 8 Pages.

The State Intellectual Property Office of PRC (SIPO) The First Office Action for CN Application No. 201710480102.1 Mar. 1, 2019 9 Pages (Translation Included ).

* cited by examiner

AIR CONDITIONER INDOOR UNIT AND AIR CONDITIONER

CROSS-REFERENCE TO RELATED APPLICATIONS

This application is a continuation of International Application No. PCT/CN2017/105096, filed Sep. 30, 2017, which claims priority to Chinese Application No. 201710480102.1, filed Jun. 21, 2017, the entire contents of both of which are incorporated herein by reference.

TECHNICAL FIELD

The present disclosure relates to the technical field of air conditioners, in particular to an air conditioner indoor unit and an air conditioner.

BACKGROUND

An air conditioner indoor unit usually includes a water receiving tray at the lower end of the heat exchanger, and water outlet hoses at the left end and the right end of the water receiving tray, respectively. Condensed water on the heat exchanger may fall into the water receiving tray, then be discharged through the drainage pipe and the water outlet hoses. However, baffles for preventing air leakage and exposure of the internal components are normally arranged at the left end and the right end of the air outlet frame of the air conditioner indoor unit. Meanwhile, a part of housing having the air outlet may block the connection portion between the water outlet hose and the drainage pipe, and it is difficult to disassemble this part. So the connection portion between the water outlet hose and the drainage pipe cannot be seen from the front of the air conditioner indoor unit. When the drainage pipe needs to be disassembled, it is very troublesome to remove the air conditioner indoor unit from the wall, then manually twist out the drainage pipe from the back of the indoor unit. So it is inconvenient to disassemble, assemble and repair the water outlet hose and the drainage pipe.

SUMMARY

The main purpose of the present disclosure is to provide an air conditioner indoor unit and an air conditioner, aiming at improving the disassembly and assembly conveniences of the water outlet hose and the drainage pipe of the air conditioner indoor unit.

In order to achieve the above objective, the air conditioner indoor unit of the present disclosure includes an air outlet frame, a front water receiving tray and a panel. The air outlet frame includes: an upper enclosure plate; a lower enclosure plate; and two opposite side enclosure plates located between the upper enclosure plate and the lower enclosure plate. The front water receiving tray is at an upper end of the upper enclosure plate, and includes: two protrusion sections protruding out of the side enclosure plates, and two water outlet hoses. A receiving cavity with a forward opening is formed below a lower side of each of the two protrusion sections. Each water outlet hose is received in one corresponding receiving cavity. The panel includes a first cover member and a second cover member. One of the two receiving cavities is covered by the first cover member and the other one is covered by the second cover member, when the panel is in a closed state; and front sides of the two receiving cavities are exposed from the air conditioner indoor unit, when the panel is in an open state.

In some embodiments, the panel includes: an upper panel; and a lower panel cooperated with the upper panel to cover a front side of the face frame, and including an air outlet connected to the air outlet frame, a lower end of the lower panel being connected to a lower end of the chassis, and the first cover member and the second cover member being both arranged on the lower panel; the face frame includes: an upper support, an upper end of the upper panel being connected to a front end of the upper support; a lower frame; and two opposite side connectors located between the upper support and the lower frame.

In some embodiments, the second cover member includes: a side board extending rearwards from a side of the air outlet away from the first cover member; and a convex board protruding rearwards, an upper end edge of the convex board being tightly connected to an upper edge of the air outlet, a lower end edge of the convex board being tightly connected to a lower edge of the air outlet; and one end of the convex board away from the first cover member is tightly connected to the side board; and one end of the convex board facing the first cover member tightly abuts against an outer board surface of one side enclosure plate adjacent to the convex board, when the lower panel is in a closed state.

In some embodiments, the side enclosure plate adjacent to the second cover member includes a support edge arranged on an outer panel surface of the side enclosure plate and extending away from the other side enclosure plate; and the support edge abuts against a rear board surface of the convex board, when the lower panel is in a closed state.

In some embodiments, a gap is formed between the convex board and the water outlet hose, when the lower panel is in the closed state.

In some embodiments, the air guide assembly of the air conditioner indoor unit is arranged on the lower panel; the convex board, the side board, and the side enclosure plate adjacent to the side board enclose to form an avoiding cavity with a forward opening; and the air guide assembly includes: an air deflector provided at the air outlet and rotatably received in the avoiding cavity; and a driving mechanism configured for driving the air deflector.

In some embodiments, the driving mechanism is arranged on an outside surface of the side board and connected to the electric control box through the connecting wire;

when the lower panel is in an open state, a distance between a connection point of the connecting wire and the motor and a connection point of the connecting wire and the electric control box is L, and a length of the connecting wire is greater than L.

In some embodiments, the indoor unit includes two connecting terminals arranged on the connecting wire, the two connecting terminals are detachably connected with each other.

In some embodiments, the second cover member and the driving mechanism are both arranged at one end of the air outlet adjacent to the electric control box; and the connecting wire is accommodated in the receiving cavity, when the lower panel is in the closed state.

In some embodiments, the lower panel further includes a connecting plate extending backwards from an edge of the air outlet; and when the lower panel is in a closed state, the connecting plate is connected to an inner wall surface of an air duct of the air outlet frame.

The present disclosure further provides an air conditioner, the air conditioner includes an air outlet frame, a front water receiving tray and a panel. The air outlet frame includes: an upper enclosure plate; a lower enclosure plate; and two opposite side enclosure plates located between the upper enclosure plate and the lower enclosure plate. The front water receiving tray is at an upper end of the upper enclosure plate, and includes: two protrusion sections protruding out of the side enclosure plates, and two water outlet hoses. A receiving cavity with a forward opening is formed below each of the two protrusion sections. Each water outlet hose is received in one corresponding receiving cavity. The panel includes a first cover member and a second cover member. One of the two receiving cavities is covered by the first cover member and the other one is covered by the second cover member, when the panel is in a closed state; and front sides of the two receiving cavities are exposed from the air conditioner indoor unit, when the panel is in an open state.

In some embodiments, the panel includes: an upper panel; and a lower panel cooperated with the upper panel to cover a front side of the face frame, and including an air outlet connected to the air outlet frame, a lower end of the lower panel being connected to a lower end of the chassis, and the first cover member and the second cover member being both arranged on the lower panel; the face frame includes: an upper support, an upper end of the upper panel being connected to a front end of the upper support; a lower frame; and two opposite side connectors located between the upper support and the lower frame.

In some embodiments, the second cover member includes: a side board extending rearwards from a side of the air outlet away from the first cover member; and a convex board protruding rearwards, an upper end edge of the convex board being tightly connected to an upper edge of the air outlet, a lower end edge of the convex board being tightly connected to a lower edge of the air outlet; and one end of the convex board away from the first cover member is tightly connected to the side board; and one end of the convex board facing the first cover member tightly abuts against an outer board surface of one side enclosure plate adjacent to the convex board, when the lower panel is in a closed state.

In some embodiments, the side enclosure plate adjacent to the second cover member includes a support edge arranged on an outer panel surface of the side enclosure plate and extending away from the other side enclosure plate; and the support edge abuts against a rear board surface of the convex board, when the lower panel is in a closed state.

In some embodiments, a gap is formed between the convex board and the water outlet hose, when the lower panel is in the closed state.

In some embodiments, the air guide assembly of the air conditioner indoor unit is arranged on the lower panel; the convex board, the side board, and the side enclosure plate adjacent to the side board enclose to form an avoiding cavity with a forward opening; and the air guide assembly includes: an air deflector provided at the air outlet and rotatably received in the avoiding cavity; and a driving mechanism configured for driving the air deflector.

In some embodiments, the driving mechanism is arranged on an outside surface of the side board and connected to the electric control box through the connecting wire;

when the lower panel is in an open state, a distance between a connection point of the connecting wire and the motor and a connection point of the connecting wire and the electric control box is L, and a length of the connecting wire is greater than L.

In some embodiments, the indoor unit includes two connecting terminals arranged on the connecting wire, the two connecting terminals are detachably connected with each other.

In some embodiments, the second cover member and the driving mechanism are both arranged at one end of the air outlet adjacent to the electric control box; and the connecting wire is accommodated in the receiving cavity, when the lower panel is in the closed state.

In some embodiments, the lower panel further includes a connecting plate extending backwards from an edge of the air outlet; and when the lower panel is in a closed state, the connecting plate is connected to an inner wall surface of an air duct of the air outlet frame.

In the technical solution of the present disclosure, since the air guide assembly can be opened together with the panel, and the front side of the cavity containing the water outlet hose can be exposed by opening the panel. The drainage pipe and the water outlet hose, which are both received in the receiving cavity formed at the front of the air conditioner indoor unit, may be easily separated from each other, when it needs to disassemble or assemble the drainage pipe. So that the disassembly and assembly conveniences of the water outlet hose and the drainage pipe are improved. Meanwhile, the panel further includes the first cover member and the second cover member which are configured for covering the two containing cavities, respectively. When the panel is in the closed state and the air conditioner indoor unit is in use, the internal assemblies exposed from the receiving cavity are effectively blocked by the two cover members, thereby preventing the cold wind from the air conditioner indoor unit to enter the receiving cavities, further preventing the occurrence of condensation in the air conditioner indoor unit. In addition, in the technical solution of the present disclosure, as the air guide assembly can be opened together with the panel, it is convenient to disassemble of the air duct assembly relevant to the air outlet frame, thereby providing a great convenience for maintaining and cleaning the relevant components.

BRIEF DESCRIPTION OF THE DRAWINGS

The technical solutions of the embodiments of the present disclosure will be clearly described in the following with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

DESCRIPTION OF REFERENCE NUMERALS

Figure 1:
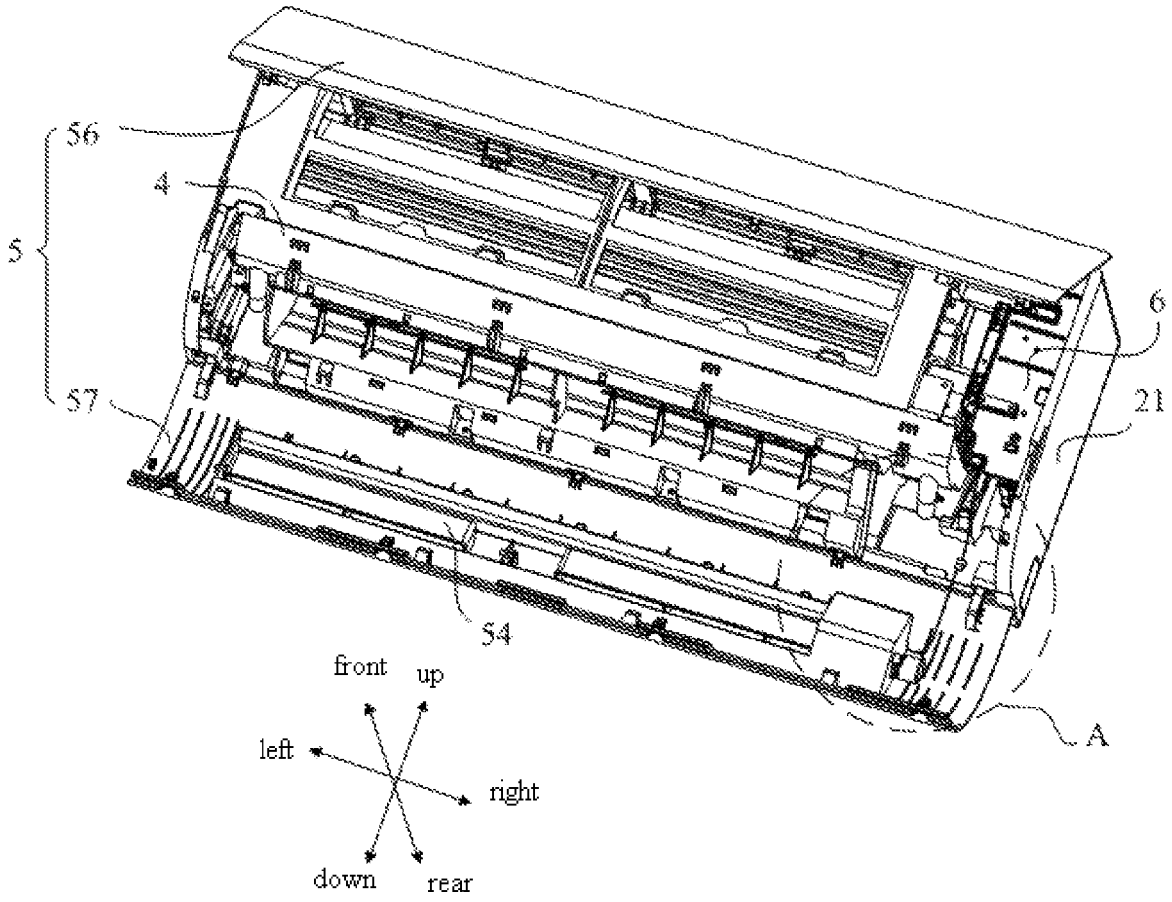
FIG. 1 is a schematic structural view of a panel of an air conditioner indoor unit according to an embodiments of the present disclosure, and the panel is in an open state.

| Reference Numeral | Name | Reference Numeral | Name |
|---|---|---|---|
| 11 | Rear enclosure plate | 111 | Through hole |
| 6 | Electric control box | 21 | Side connector |
| 3 | Air outlet frame | 31 | Upper enclosure plate |
| 32 | Lower enclosure plate | 33 | Side enclosure plate |
| 331 | support edge | 4 | Front water receiving tray |
| 41 | Protrusion section | 42 | Receiving cavity |
| 43 | Water outlet hose | 5 | Panel |
| 51 | Air outlet | 52 | First cover member |
| 53 | Second cover member | 54 | Air deflector |
| 55 | Driving mechanism | 56 | Upper panel |
| 57 | Lower panel | 571 | Connecting plate |
| 531 | Convex board | 532 | Side board |
| 551 | Connecting wire | 552 | Connecting terminal |

The implementation, functional characteristics and advantages of the present disclosure will be further described with reference to the attached drawings in combination with embodiments.

DETAILED DESCRIPTION OF THE EMBODIMENTS

As following, the technical solution in the embodiments of the present disclosure will be described clearly with reference to the drawings in the embodiments of the present disclosure. Obviously, the described embodiments are only some of the embodiments of the present disclosure, not all of the embodiments. Based on the embodiments of the present disclosure, all other embodiments perceived by those ordinary skills in the art without creative effort should be fallen within the scope of the present disclosure.

It should be noted that all directional indicators (such as upper, lower, left, right, front, rear, etc.) in the embodiments of the present disclosure are only used to explain the relative positional relationship, movement, etc., between various assemblies under a certain specific posture (as shown in the drawings). If the specific posture changes, the directional indicator will also change accordingly.

In addition, descriptions related to "first," "second," etc., in the exemplary embodiments of present disclosure, can only be used for descriptive purposes, and cannot be understood as indicating or suggesting relative importance or impliedly indicating the number of the indicated technical character. Therefore, the character indicated by "first," "second" can expressly or impliedly include at least one character. In addition, the technical solutions of various embodiments can be combined with each other as long as there is no conflict.

The present disclosure proposes an air conditioner indoor unit.

In some embodiments of the present disclosure, referring to FIG. 1 to FIG. 8, the air conditioner indoor unit is a wall-mounted air conditioner indoor unit. The air conditioner indoor unit includes a chassis (not labeled), a face frame, an air outlet frame 3, a front water receiving tray 4, a panel 5, and an air guide assembly. The chassis includes a rear enclosure plate 11 extending forwards and downwards. The face frame (not labeled) includes an upper support (not labeled), a lower frame (not labeled), and two opposite side connectors 21 located between the upper support and the lower frame. The air outlet frame 3 includes an upper enclosure plate 31, a lower enclosure plate 32, and two opposite side enclosure plates 33 located between the upper enclosure plate 31 and the lower enclosure plate 32. The front water receiving tray 4 is formed above the upper enclosure plate 31. The front water receiving tray 4 includes two protrusion sections 41 protruding from the side enclosure plates 33, respectively. A receiving cavity 42 opening forward is formed below each of the two protrusion sections 41. Each of the two protrusion sections 41 includes a water outlet hose 43 received in a corresponding receiving cavity 42. The panel 5 includes a first cover member 52 and a second cover member 53 adjacent to the left end and the right end of an air outlet 51, respectively. When the panel 5 is in a closed state, one of the two receiving cavities 42 is covered by the first cover member 52 and the other one is covered by the second cover member 53. When the panel 5 is in an open state, front sides of the two receiving cavities 42 are exposed from the air conditioner indoor unit.

For at least one receiving cavity 42, a through hole 111 is formed at a position of the rear enclosure plate 11 that corresponds to an opening of the water outlet hose 43. The drainage pipe (not shown) of the air conditioner indoor unit is passed through the through hole 111 to be detachably connected to the water outlet hose 43. That is, the connection portion of the water outlet hose 43 and the drainage pipe is accommodated in the receiving cavity 42. In addition, in some embodiments, an air guide vane of the air conditioner indoor unit may be arranged in the air outlet 51 of the panel 5.

In the present embodiment, the air guide assembly can be opened together with the panel 5, and the front side of the cavity 42 containing the water outlet hose 43 can be exposed by opening the panel 5. Thus, when it needs to the drainage pipe needs to be mounted or dismounted, the drainage pipe and the water outlet hose 43 can be easily separated from each other in the receiving cavity 42 formed at the front of the air conditioner indoor unit. As such, it is more convenient to dismount or mount the water outlet hose 43 and the drainage pipe. Meanwhile, the panel 5 further includes the first cover member 52 and the second cover member 53, which are configured for covering the two containing cavities 42, respectively. When the panel 5 is in the closed state and the air conditioner indoor unit is in use, the internal assemblies exposed from the receiving cavity 42 are effectively blocked by the two cover members, thereby preventing cold wind outputted by the air conditioner indoor unit from entering the receiving cavities 42, further preventing the occurrence of condensation in the air conditioner indoor unit. In addition, in the technical solution of the present disclosure, as the air guide assembly can be opened together with the panel 5, it is convenient to remove the air duct assembly relevant to the air outlet frame 3, thereby providing a great convenience for maintaining and cleaning the relevant components.

Figure 3:
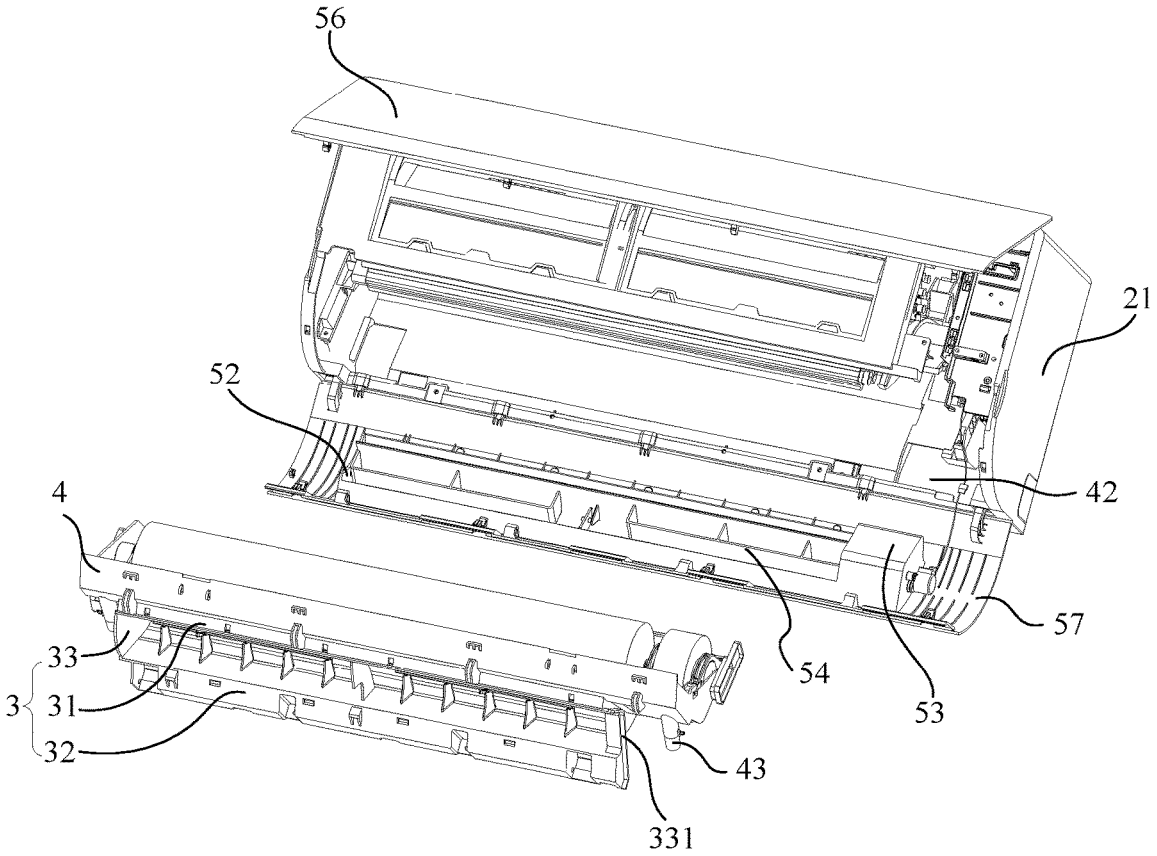
FIG. 3 is an exploded view of the panel in FIG. 1.
Figure 8:
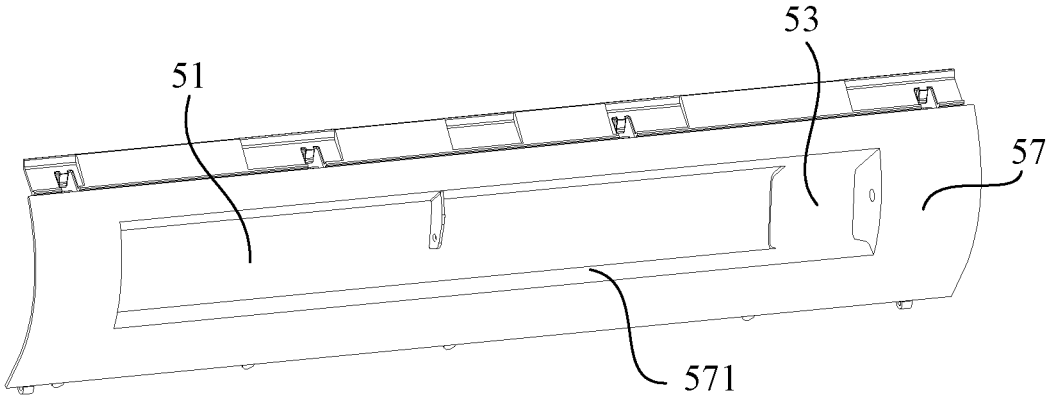
FIG. 8 is a schematic structural view of the lower panel in FIG. 4, but shown from another view.

Specifically, referring to FIG. 1, FIG. 3, and FIG. 8, in the present embodiment, the panel 5 includes an upper panel 56 and a lower panel 57 cooperated with the upper panel 56 to cover a front side of the face frame. An upper end of the upper panel 56 is connected to a front end of the upper support. A lower end of the lower panel 57 is connected to a lower end of the chassis. The panel 5 is provided with an air outlet 51, and the air outlet 51 is connected to the air outlet frame 3. The first cover member 52 and the second cover member 53 are both on the lower panel 57. In some other embodiments, the panel 5 may also be provided as a whole plate, and the panel 5 can be opened from its upper end or lower end. However, in the present embodiment, the panel 5 includes the upper panel 56 and the lower panel 57, and the upper panel 56 and the lower panel 57 are both opened in a rotative manner. As such, the air conditioner indoor unit can be maintained conveniently, and the user experience is improved. When only the filter needs to be cleaned, only the upper panel 56 needs to be opened. When the air outlet frame 3 or the like needs to be deeply cleaned, the lower panel 57 and the upper panel 56 can be opened.

Figure 2:
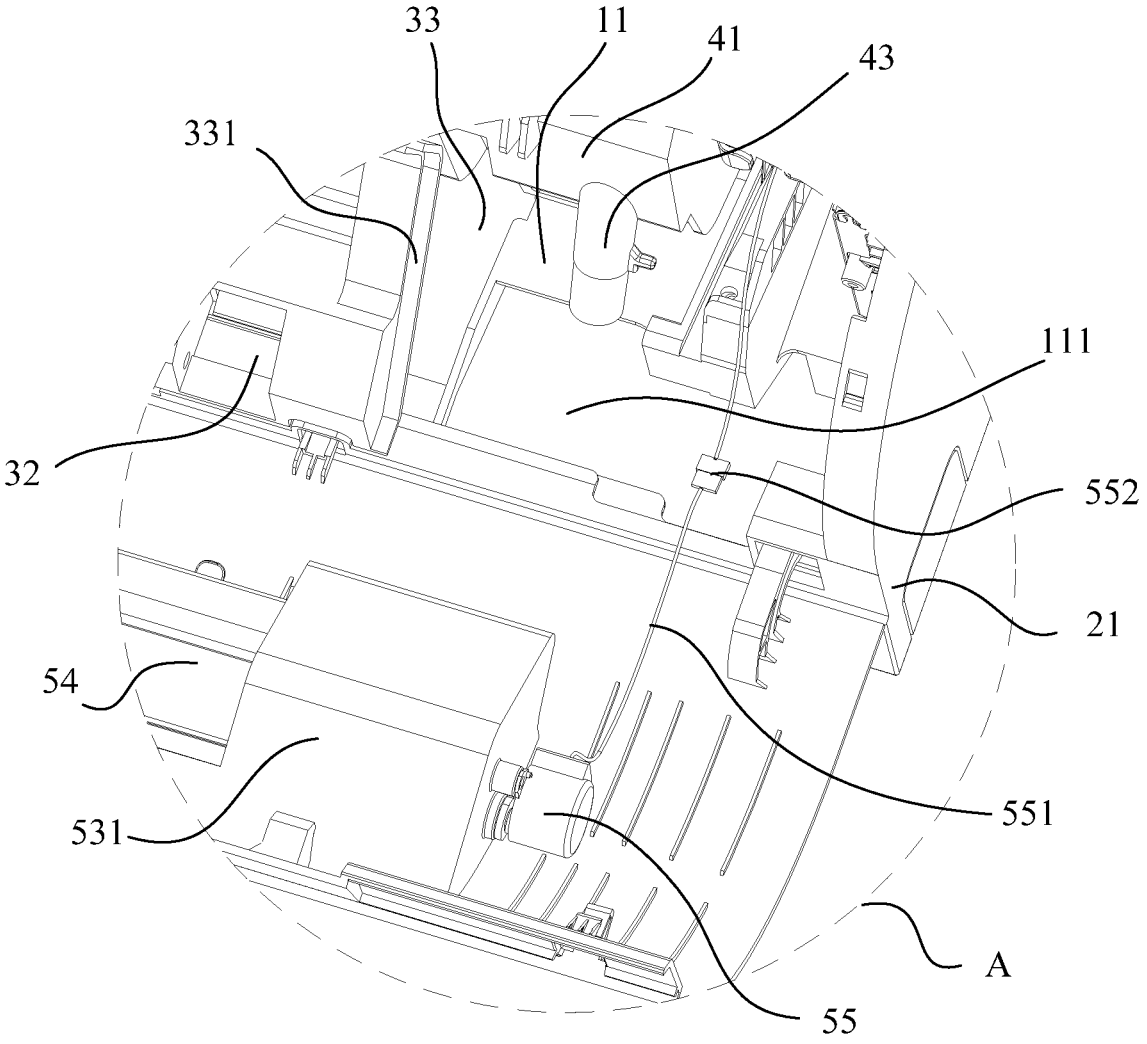
FIG. 2 is an enlarged view of portion A in FIG. 1.
Figure 4:
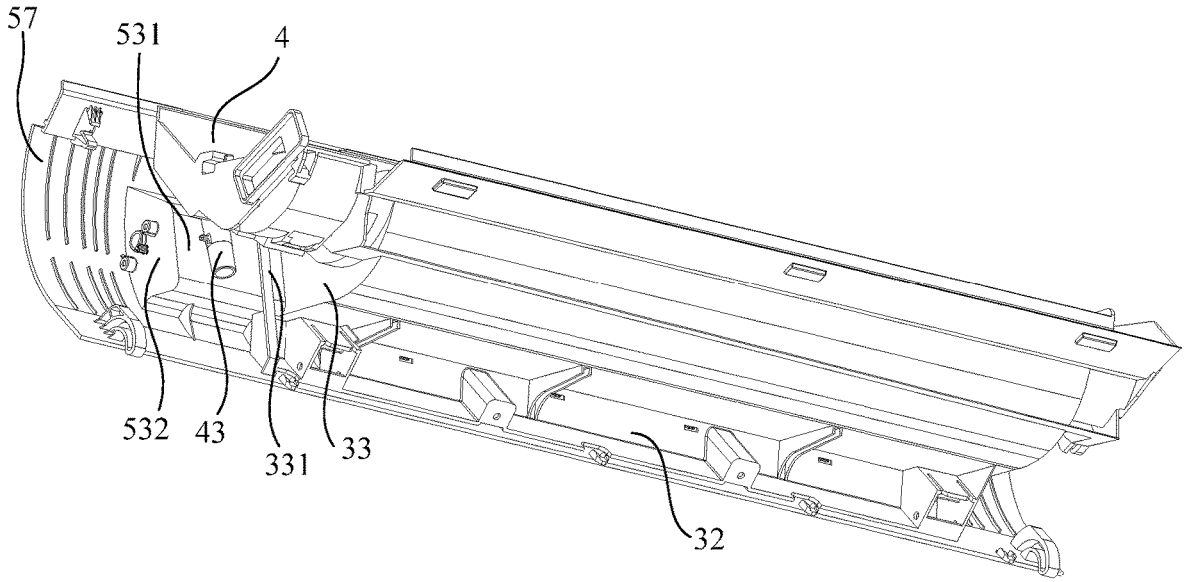
FIG. 4 is a schematic structural view of a lower panel, an air guide assembly, an air outlet frame, and a front water receiving tray in FIG. 1, which are in an assembled state.
Figure 5:
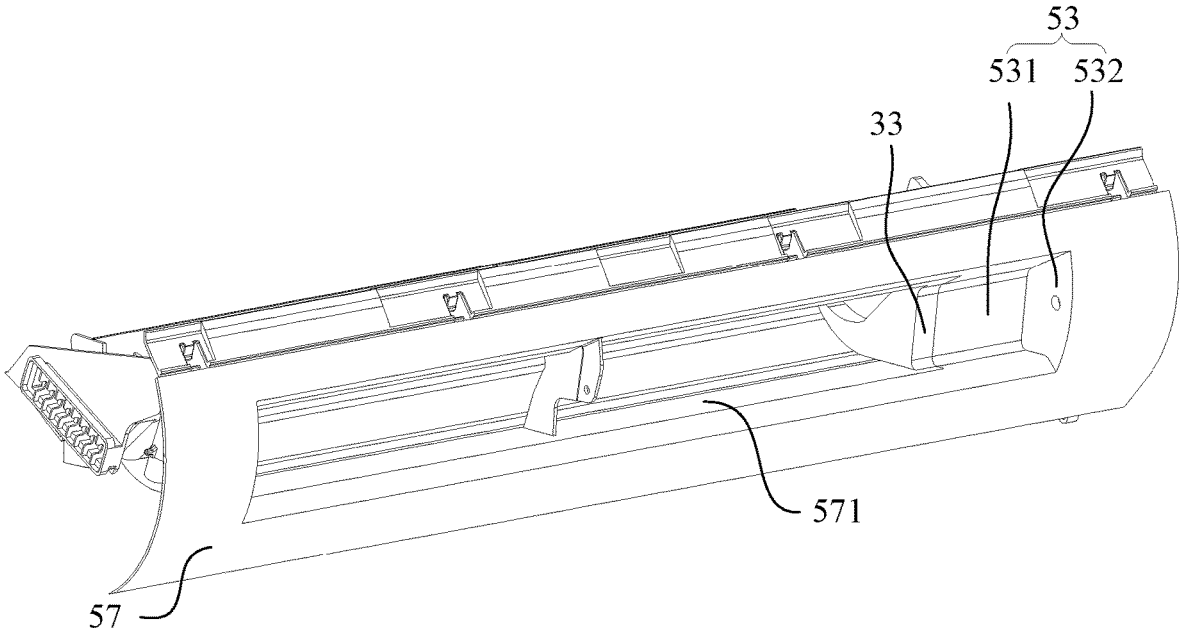
FIG. 5 is similar to FIG. 4, but shown from another view.
Figure 6:
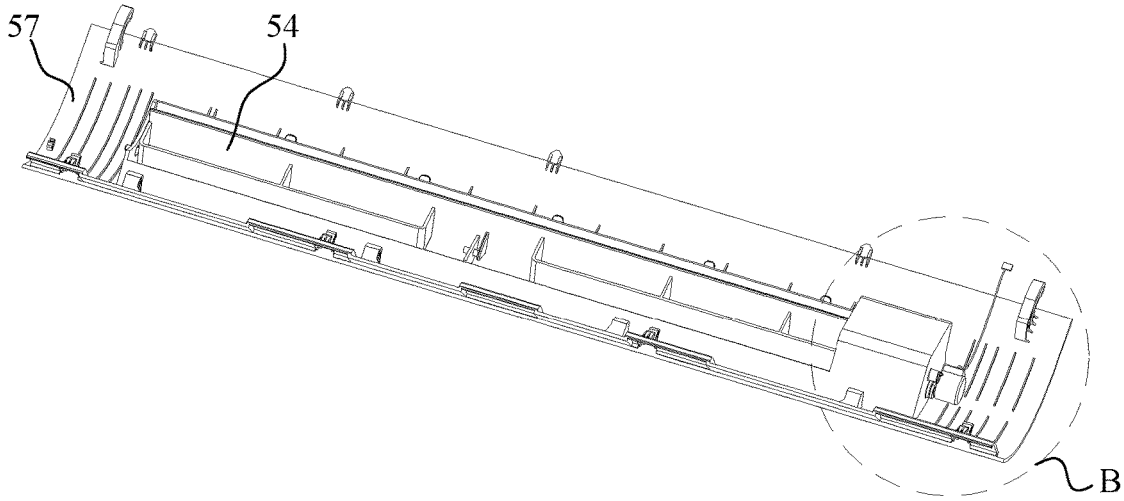
FIG. 6 is a schematic structural view of the lower panel and the air guide assembly in FIG. 4, which are in the assembled state.
Figure 7:
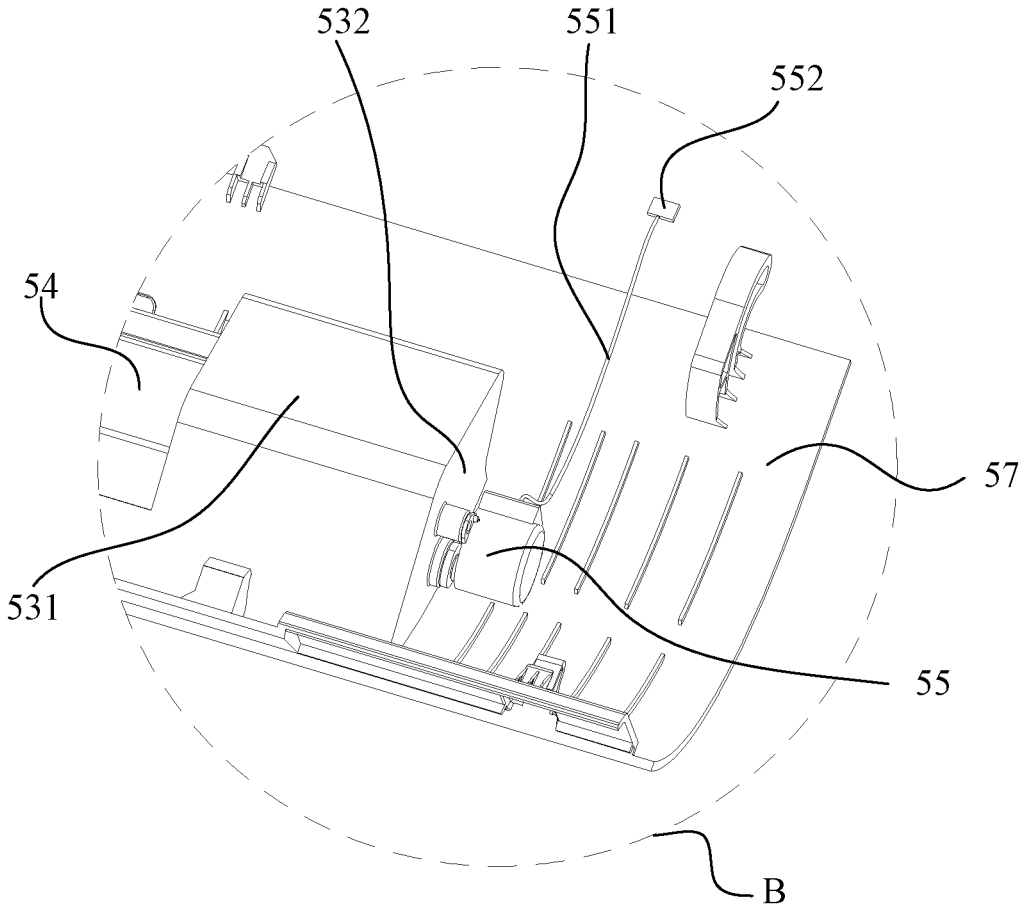
FIG. 7 is an enlarged view of portion B of FIG. 6.

Specifically, referring to FIG. 2, FIG. 4, and FIG. 7, in the present embodiment, the second cover member 53 includes a side board 532 extending rearwards from a side of the air outlet away from the first cover member, and a convex board 531 protruding rearwards, an upper end edge of the convex board 531 being tightly connected to an upper edge of the air outlet 51, a lower end edge of the convex board 531 being tightly connected to a lower edge of the air outlet 51. When the lower panel 57 is in a closed state, one end of the convex board 531 away from the first cover member 52 is tightly connected to the side board 532, and another end of the convex board 531 facing the first cover member 52 tightly abuts against an outer board surface of one side enclosure plate 33 adjacent to the convex board 531. So that the receiving cavity 42 is covered. In addition, the convex board 531 is located in front of the water outlet hose 43 after the receiving cavity 42 is covered. And a gap is formed between the convex board 531 and the water outlet hose 43 to prevent a damage during covering the receiving cavity 42. In addition, in the present embodiment, the first cover member 52 is a flange opposite to the side board 532, and the flange extends rearwards from a side of the air outlet 51 away from the second cover member 53. When the lower panel 57 is in a closed state, the flange tightly abuts against the adjacent side enclosure plate 33. The air guide assembly of the air conditioner indoor unit is arranged on the lower panel 57; the convex board 531, the side board 532, and the side enclosure plate 33 adjacent to the side board enclose to form an avoiding cavity with a forward opening; and the air guide assembly includes an air deflector 54 arranged at the air outlet and rotatably received in the avoiding cavity, and a driving mechanism 55 configured for driving the air deflector. Thereby there exist a space provided for the rotating of the wind deflector 54, to prevent the second cover member 53 and the air deflector 54 from interfering with each other. In addition, the convex boards 531 and the side boards 532 are symmetrically with respect to the air outlet 51, for achieving a beautiful appearance.

Further, referring to FIG. 3, in the present embodiment, the side enclosure plate 33 adjacent to the second cover member 53 includes a support edge 331 arranged on an outer board surface of the side enclosure plate 33 and extending away from the other side enclosure plate 33; and the support edge 331 abuts against a rear board surface of the convex board 531, when the lower panel 57 is in a closed state. It should be noted that the setting of the support edge 331 can improve the sealing tightness of the second cover member 53 and the side enclosure plate 33, to prevent the cold air from entering into the receiving cavity 42 and causing the condensation phenomenon. On the other hand, the setting of the support edge 331 can position the convex board 531 to a certain extent.

Referring to FIG. 1, FIG. 2 and FIG. 7, in some embodiments, in order to reduce the interference during rotation of the lower panel 57, the second cover member 53 and the driving mechanism 55 are both arranged at one end of the air outlet 51 adjacent to the electric control box 6. Specifically, the driving mechanism 55 is a driving motor. In some embodiments, the driving mechanism is arranged on an outside surface of the side board 532 and connected to the electric control box 6 of the air conditioner indoor unit through the connecting wire 551, for controlling the rotation of the air deflector 54.

Further, when the lower panel 557 is in an open state, a distance between a connection point of the connecting wire 551 and the motor and a connection point of the connecting wire 551 and the electric control box 6 is L, and a length of the connecting wire 551 is greater than L. When the lower panel 57 is in the closed state, the connecting wire 551 is accommodated in the receiving cavity 42. The overlong setting of the connecting wire 551 can prevent the lower panel 57 from pulling and damaging the connecting wire 551 during the rotation of the lower panel 57. And the connecting wire does not interfere with the rotation of the lower panel 57. Further, referring to FIG. 2 and FIG. 7, two connecting terminals 552 are arranged on the connecting wire 551, and are detachably connected with each other. In this way, when the driving mechanism 55 needs to be removed together with the lower panel 57, the connecting wire 551 can be easily removed from the connecting terminal 552 without removing the driving mechanism 55 or removing the electric control box 6. Thus, it is more convenient to dismount or mount the driving mechanism 55.

In addition, referring to FIG. 8, in the present embodiment, the lower panel 57 further includes a connecting plate 571 extending backwards from an edge of the air outlet 51. When the lower panel 57 is in a closed state, the connecting plate 571 is connected to an inner wall surface of an air duct of the air outlet frame 3, so that a smooth air outlet duct can be formed. The setting of the connecting plate 571 also provides more rotation space for the air deflector 54.

The present disclosure also provides an air conditioner. The air conditioner includes an air conditioner indoor unit. For the specific structure of the air conditioner indoor unit, reference can be made to the above exemplary embodiments. As the air conditioner adopts all the technical solutions of the above exemplary embodiments, the air conditioner at least has all of the beneficial effects of the technical solutions of the above exemplary embodiments, and details thereof are not repeated.

The foregoing description merely portrays some illustrative embodiments according to the disclosure and therefore is not intended to limit the scope of the disclosure. Any equivalent structural or flow transformations that are made taking advantage of the specification and accompanying drawings of the disclosure and any direct or indirect applications thereof in other related technical fields shall all fall in the scope of the disclosure.

What is claimed is:

1. An air conditioner indoor unit, comprising:
an air outlet frame including:
an upper enclosure plate;
a lower enclosure plate; and
a side enclosure plate located between and connecting the upper enclosure plate and the lower enclosure plate;
a front water receiving tray above the upper enclosure plate and including:
a protrusion section protruding out of the side enclosure plate; and
a water outlet hose at the protrusion section, the water outlet hose being configured to be received in a receiving cavity formed below the protrusion section, and the receiving cavity opening forward; and
a panel including a cover member configured to cover the receiving cavity when the panel is in a closed state.

2. The indoor unit of claim 1, further comprising:
a chassis; and
a face frame including:
an upper support;
a lower frame; and
a side connector located between and connecting the upper support and the lower frame;
wherein the panel includes:
an upper panel, an upper end of the upper panel being connected to a front end of the upper support; and
a lower panel cooperated with the upper panel to cover a front side of the face frame, a lower end of the lower panel being connected to a lower end of the chassis, the lower panel including an air outlet connected to the air outlet frame, and the cover member being arranged at the lower panel.

3. The indoor unit of claim 2, wherein:
the cover member includes:
a side board extending rearwards from a side of the air outlet; and
a convex board protruding rearwards, an upper end edge of the convex board being tightly connected to an upper edge of the air outlet, a lower end edge of the convex board being tightly connected to a lower edge of the air outlet, and a first side end of the convex board being tightly connected to the side board; and
a second side end of the convex board opposite to the first side end is configured to tightly abut against an outer board surface of the side enclosure plate when the lower panel is in a closed state.

4. The indoor unit of claim 3, wherein the side enclosure plate includes a support edge arranged on an outer panel surface of the side enclosure plate and configured to abut against a rear board surface of the convex board when the lower panel is in the closed state.

5. The indoor unit of claim 3, wherein a gap is formed between the convex board and the water outlet hose when the lower panel is in the closed state.

6. The indoor unit of claim 3, further comprising:
an air guide assembly arranged at the lower panel and including:
an air deflector provided at the air outlet; and
a driving mechanism configured to drive the air deflector;
wherein the convex board, the side board, and the side enclosure plate enclose to form an avoiding cavity opening forward opening, the air deflector being rotatably received in the avoiding cavity.

7. The indoor unit of claim 6, further comprising:
an electric control box;
wherein:
the driving mechanism includes a connecting wire;
the driving mechanism is arranged on an outside surface of the side board and connected to the electric control box through the connecting wire; and
a length of the connecting wire is greater than a distance between a connection point of the connecting wire and the driving mechanism and a connection point of the connecting wire and the electric control box when the lower panel is in an open state.

8. The indoor unit of claim 7, further comprising:
two connecting terminals arranged on the connecting wire and detachably connected with each other.

9. The indoor unit of claim 7, wherein:
the cover member and the driving mechanism are both arranged at one end of the air outlet adjacent to the electric control box; and
the connecting wire is accommodated in the receiving cavity when the lower panel is in the closed state.

10. The indoor unit of claim 2, wherein:
the lower panel further includes a connecting plate extending backwards from an edge of the air outlet; and
when the lower panel is in a closed state, the connecting plate is connected to an inner wall surface of an air duct of the air outlet frame.

11. An air conditioner, comprising:
an indoor unit
an air outlet frame including:
an upper enclosure plate;
a lower enclosure plate; and
a side enclosure plate located between and connecting the upper enclosure plate and the lower enclosure plate;
a front water receiving tray above the upper enclosure plate and including:
a protrusion section protruding out of the side enclosure plate; and
a water outlet hose at the protrusion section, the water outlet hose being configured to be received in a receiving cavity formed below the protrusion section, and the receiving cavity opening forward; and
a panel including a cover member configured to cover the receiving cavity when the panel is in a closed state.

12. The air conditioner of claim 11, wherein the indoor unit further includes:
a chassis; and
a face frame including:
an upper support;
a lower frame; and
a side connector located between and connecting the upper support and the lower frame;

wherein the panel includes:

an upper panel, an upper end of the upper panel being connected to a front end of the upper support; and a lower panel cooperated with the upper panel to cover a front side of the face frame, a lower end of the lower panel being connected to a lower end of the chassis, the lower panel including an air outlet connected to the air outlet frame, and the cover member being arranged at the lower panel.

13. The air conditioner of claim 12, wherein:

the cover member includes:

a side board extending rearwards from a side of the air outlet; and a convex board protruding rearwards, an upper end edge of the convex board being tightly connected to an upper edge of the air outlet, a lower end edge of the convex board being tightly connected to a lower edge of the air outlet, and a first side end of the convex board being tightly connected to the side board; and a second side end of the convex board opposite to the first side end is configured to tightly abut against an outer board surface of the side enclosure plate when the lower panel is in a closed state.

14. The air conditioner of claim 13, wherein the side enclosure plate includes a support edge arranged on an outer panel surface of the side enclosure plate and configured to abut against a rear board surface of the convex board when the lower panel is in the closed state.

15. The air conditioner of claim 13, wherein a gap is formed between the convex board and the water outlet hose when the lower panel is in the closed state.

16. The air conditioner of claim 13, wherein:

the indoor unit further includes an air guide assembly arranged at the lower panel and including:

an air deflector provided at the air outlet; and a driving mechanism configured to drive the air deflector; and the convex board, the side board, and the side enclosure plate enclose to form an avoiding cavity opening forward opening, the air deflector being rotatably received in the avoiding cavity.

17. The air conditioner of claim 16, wherein:

the indoor unit further includes an electric control box;

the driving mechanism includes a connecting wire;

the driving mechanism is arranged on an outside surface of the side board and connected to the electric control box through the connecting wire; and a length of the connecting wire is greater than a distance between a connection point of the connecting wire and the driving mechanism and a connection point of the connecting wire and the electric control box when the lower panel is in an open state.

18. The air conditioner of claim 17, wherein the indoor unit further includes two connecting terminals arranged on the connecting wire and detachably connected with each other.

19. The air conditioner of claim 17, wherein:

the cover member and the driving mechanism are both arranged at one end of the air outlet adjacent to the electric control box; and the connecting wire is accommodated in the receiving cavity when the lower panel is in the closed state.

20. The air conditioner of claim 12, wherein:

the lower panel further includes a connecting plate extending backwards from an edge of the air outlet; and when the lower panel is in a closed state, the connecting plate is connected to an inner wall surface of an air duct of the air outlet frame.

* * * * *